US009540210B1

(12) United States Patent
Phillips et al.

(10) Patent No.: US 9,540,210 B1
(45) Date of Patent: Jan. 10, 2017

(54) BELT CORE SYSTEM

(71) Applicant: Maxi-Lift, Inc., Addison, TX (US)

(72) Inventors: Paul Phillips, Frisco, TX (US); Wade Randall Spencer, Hutchinson, KS (US); Jeffrey Carlisle Jowers, Coppell, TX (US)

(73) Assignee: Maxi-Lift, Inc., Addison, TX (US)

( * ) Notice: Subject to any disclaimer, the term of this patent is extended or adjusted under 35 U.S.C. 154(b) by 0 days.

(21) Appl. No.: 14/157,246

(22) Filed: Jan. 16, 2014

(51) Int. Cl.
*B65H 75/10* (2006.01)
*B65H 75/08* (2006.01)

(52) U.S. Cl.
CPC ..... *B65H 75/08* (2013.01)

(58) Field of Classification Search
CPC ..... B65H 75/10; B65H 2701/534
USPC ..... 242/613, 613.2, 611.2, 609.1
See application file for complete search history.

(56) References Cited

U.S. PATENT DOCUMENTS 382,091 A * 5/1888 Kelsea ..... B65H 75/14 242/609.1
5,971,317 A * 10/1999 Jaros ..... B65H 75/14 242/609
6,102,327 A * 8/2000 Ripplinger ..... B29C 65/56 242/118.61
2011/0089285 A1* 4/2011 Chambers ..... B65H 75/14 242/608.4

* cited by examiner

*Primary Examiner* — Sang Kim
(74) *Attorney, Agent, or Firm* — Gardere Wynne Sewell LLP

(57) ABSTRACT

Belt core and belt core systems for winding a belt or other winding material are described. The belt core and belt core system described are lightweight and reusable. The belt core and belt core system includes at least one belt core unit. A plurality of units may be combined to form a belt core system, in which each unit has the same general size and is configured with means for interlocking each unit with another unit. This provides customization of the described system so that it may accommodate a winding material of any width.

20 Claims, 3 Drawing Sheets

BELT CORE SYSTEM

TECHNICAL FIELD

The disclosure relates generally to belt cores, and more particularly, to lightweight and reusable belt cores.

BACKGROUND

Belt cores for winding and storing materials thereon, such as for example, conveyor belts, leather, or tire fabrics must be strong, durable and capable of withstanding high compressive forces. Current belt cores are typically wood-based or metallic. A longstanding problem with wood-based materials is their inability to withstand high pressure. Pressed wood cores often break and/or splinter with repetitive use and are generally more brittle. The pressed wood may also shed, leaving wood particles, sawdust or impressions in the belt or other material that is wound thereon, which oftentimes renders that region of the belt unusable. Furthermore, winding materials, when wound on wood-based cores, are nailed at one end to the wood-based core. Such nailing tends to break up the core or splinter the region, which oftentimes damages or otherwise renders the core from being reused.

Wood-based cores as well as metallic cores are generally heavy, making them cumbersome to handle and difficult to cut. Both wood-based cores and metallic cores often require many processing steps so that they are capable of withstanding the high pressures and compressive strains that will be exerted on them, which are costly and/or time consuming. For example, wood-based cores require numerous steps to fumigate and heat treat the wood before said cores can be shipped overseas.

Consequently, objects described herein are to provide new and improved belt cores that address the aforementioned deficiencies.

SUMMARY

According to a first aspect, there is provided a belt core system having a first belt core member and a second belt core member. Each belt core member includes a body with an exterior surface, and a first end and a second end, the first end having a shoulder and the second end having a lip. The lip on the second end of the second belt core member is aligned with and disposed at least partially around and abutting the shoulder on the first end of the first belt core member to form an expandable belt core system to receive a belt for storing on the exterior surface of the first and second belt core members.

In certain embodiments, the first and second belt core members further include an alignment hole extending therethrough such that when the first and second belt core members are abutted, the alignment holes are aligned and configured to receive a locking rod extending therethrough.

In other certain embodiments, the first and second belt core members each include a central opening extending between the first and second ends, the central opening configured to receive a winding shaft extending therethrough.

In yet another embodiment, at least one recessed fillet extends at least partially along the length of the central opening to facilitate removal and insertion of the winding shaft from and into the central opening.

In still another embodiment, the belt core system includes a squaring line extending at least partially along the exterior surface of at least one of the first and second belt core members.

In yet another embodiment, the squaring line is integral to and extending from the exterior surface.

In other certain embodiments, an edge of the central opening at the first end or the second end is beveled.

In yet another embodiment, the belt core system includes at least one extension extending from at least one of the first end or the second end.

In still another embodiment, the at least one extension is tapered.

In yet another embodiment, at least one recess extends from at least one of the first end or the second end sized to receive a corresponding extension from an adjacently positioned belt core unit.

In other certain embodiments, the body is formed of a plastic material.

In a second aspect, a belt core system is provided having a first belt core member and a second belt core member, each belt core member having a first end and a second end. The system further includes an alignment hole extending between the first and second ends of each of the belt core members. The first and end of the first belt core member is positioned adjacent the second of the second belt core member such that the alignment holes are coaxially aligned so as to receive a locking rod therethrough, the locking rod including a locking means on opposed ends thereof to prevent lateral relative movement between the locking rod and the belt core members.

In certain embodiments, the locking means includes a bolt threadably secured on respective ends of the locking rod to prevent relative lateral movement therebetween.

In other certain embodiments, the first and second belt cores each include a central opening extending between the first and second ends to receive a winding shaft therethrough.

In yet another embodiment, the central opening further includes at least one region along a length that is recessed to facilitate removal of the winding shaft therefrom.

In still another embodiment, the first and second belt core units each include a shoulder on the first end and a lip on the second end, wherein the shoulder on the first belt core unit engages the lip on the second unit.

In yet another embodiment, at least one of the first or second belt core units includes a squaring line.

In a third aspect, there is provided a molded belt core having a cylindrical body having an exterior surface, a first end and a second end. The belt core also includes a squaring line extending at least partially between the first end and the second end to provide an alignment mechanism for aligning and securing an end of a belt to the molded belt core for winding thereon.

In certain embodiments, the first end includes a shoulder and the second end includes an extension extending therefrom, wherein the extension is configured to engage a shoulder on an adjacently positioned belt core.

In a fourth aspect, there is provided a method of assembling a belt core system. The method includes securing a first unit to a second unit, each unit comprising an alignment hole and a central opening extending therethrough such that when securing the first unit to the second unit, the alignment hole and the centralized open are coaxially aligned. The method also includes inserting a bar through the alignment hole, wherein the bar has a length that is greater than the length of the aligned alignment hole.

In certain embodiments, the method further includes securing a locking mechanism at respective ends of the bar to prevent relative lateral movement of the first and second units relative to the bar.

Those skilled in the art will further appreciate the advantages and superior features described upon reading the description which follows in conjunction with the drawings.

BRIEF DESCRIPTION OF THE DRAWINGS

Additional features, as well as more details thereof, and the overall systems and devices described herein, will become readily apparent from a review of the following detailed description, taken in connection with the accompanying drawings, in which.

DETAILED DESCRIPTION

Figure 1:
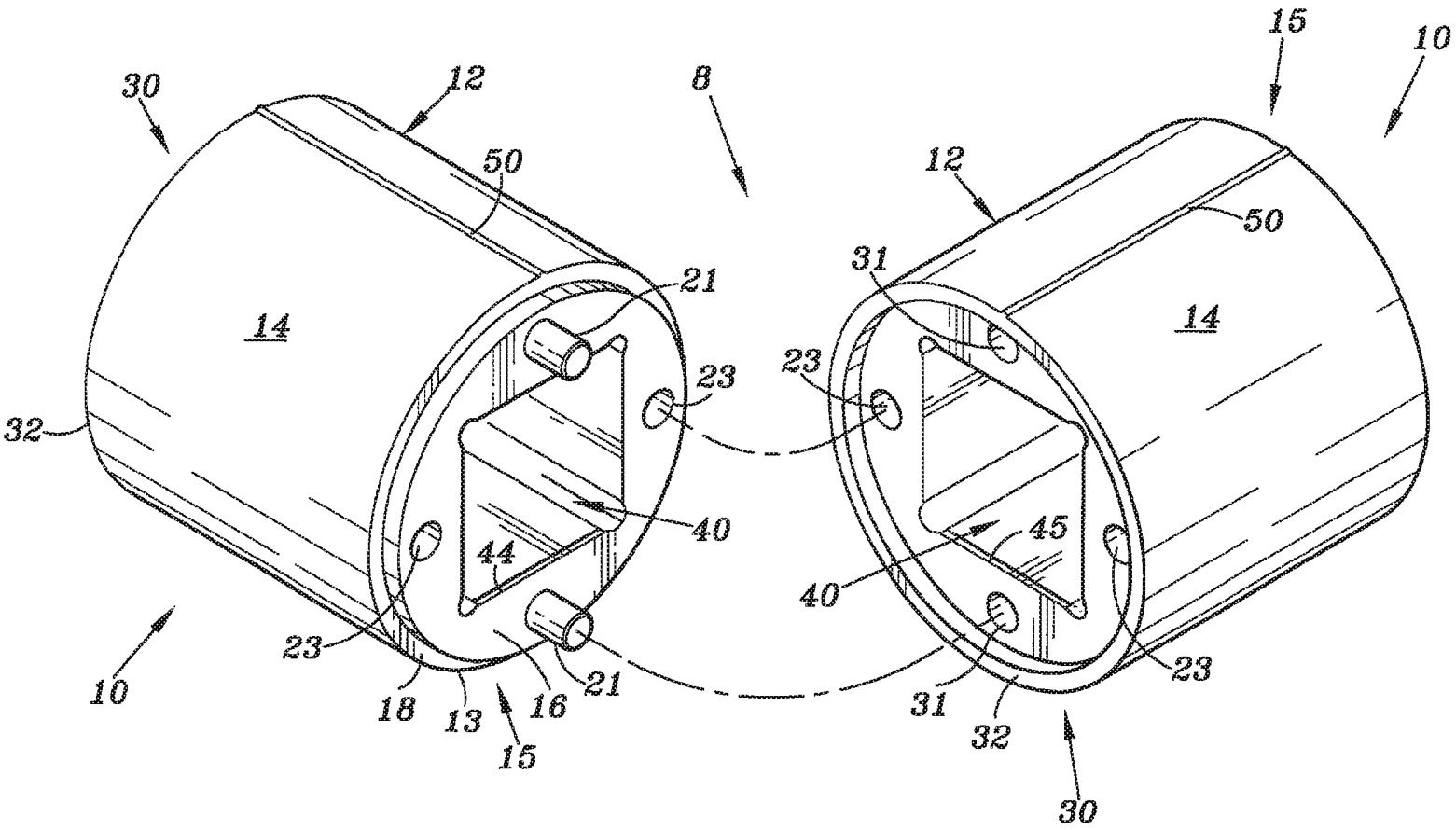
FIG. 1 is an exploded perspective view of a belt core system having first and second belt core units.

In the detailed description, like elements are marked throughout the specification and drawings with the same reference numerals, respectively. The drawing figures are not necessarily to scale and certain elements are shown in generalized or schematic form in the interest of clarity and conciseness. It should be understood that the embodiments of the disclosure herein described are merely illustrative of the principles of the invention.

Figure 4:
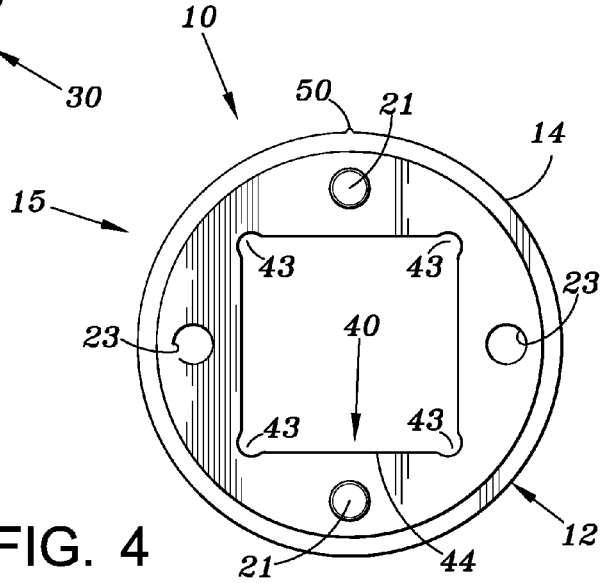
FIG. 4 depicts an end view end of the belt core unit of FIG. 2 opposite the end illustrated in FIG. 3.
Figure 5:
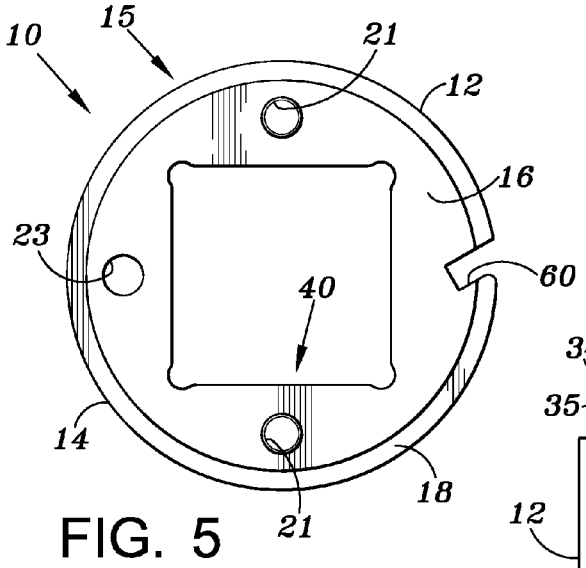
FIG. 5 is an illustration of an alternate embodiment of a belt core unit.
Figure 6:
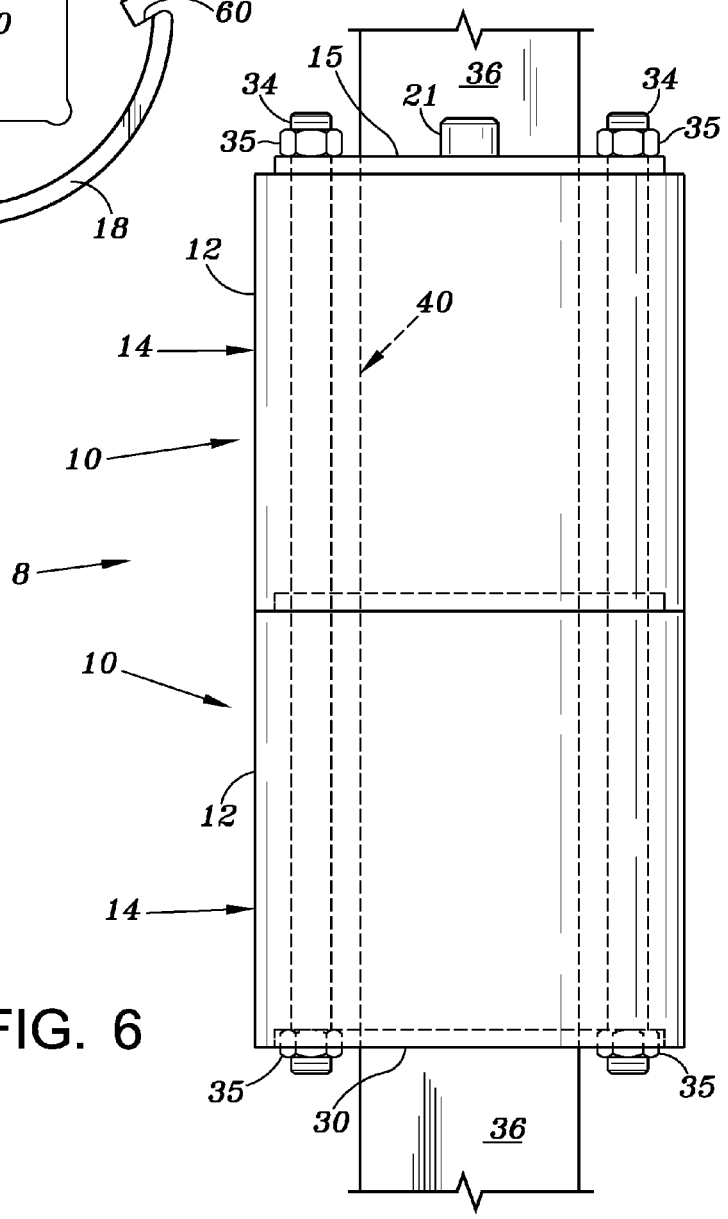
FIG. 6 depicts an assembled side view of the belt core system of FIG.

Referring to FIGS. 1 to 6, depicted therein is a representative embodiment of a belt core system 8. In FIGS. 1 and 6, for example, the belt core system 8 includes two belt core units 10 that are coupleable together, as described in greater detail below, to accommodate differing sized materials to be wound thereon and to facilitate storage and transport of varying sized and numbers of belts thereon. In the embodiment illustrated in FIGS. 1-6, each belt core unit 10, includes a body 12, a first end 15, a second end 30, a central opening 40, and a position or squaring line 50. According to some embodiments, the body 12 is cylindrically shaped to facilitate winding of a material thereon; however, any shape is suitable (i.e., oval, square, etc.). In the embodiment illustrated in FIGS. 1-6, the body 12 has an outer periphery 14, which forms an exterior surface of the belt core 10 and is shaped to receive and store a belt (not illustrated) or other object thereon. In FIG. 1, for example, an outer edge 13 is formed where the outer periphery 14 meets and otherwise terminates at the first end 15. In addition to outer edge 13, the first end 15 includes a shoulder 18 and a generally planar first surface or end 16.

Referring specifically to FIGS. 1 and 4, a pair of extensions 21 project and otherwise extend from the first surface 16 of the first end 15; however, it should be understood that a greater or fewer number of extensions 21 may be utilized and further, can be positioned at any position on the surface 16 of the first end 15 or even on the second end 30. In FIG. 1, the extensions 21 are formed having a circular cross sectional area; however, extensions 21 may be formed of any other cross-sectional shape. For example, extensions 21 may have a square, rectangular, or oval cross-section and further, the extensions 21 may be formed to gradually taper near its end or tip region 22 to facilitate assembly and interconnection of multiple belt core units 10.

In the embodiment illustrated in FIGS. 1 and 4-6, the belt core unit 10 further includes at least one bore or hole 23 that extends through the length of the body 12 between the first and second ends 15 and 30. The holes 23 are suitably shaped and sized to accept a locking rod 34 (FIG. 6). Referring specifically to FIG. 6, the locking rod 34 extends through the length of each body 12 and is fitted with a locking mechanism 35 at its respective ends (i.e., near the first end 15 and near the second end 30 of the belt core system 8). According to some embodiments, the locking mechanism 35 include, for example, nuts threaded on threaded ends of the locking rod 34, or pins (not illustrated), such as cotter pins, fitted in corresponding holes near the ends of the locking rod 34 so as to prevent movement of the belt core units 10 relative to each other.

Figure 3:
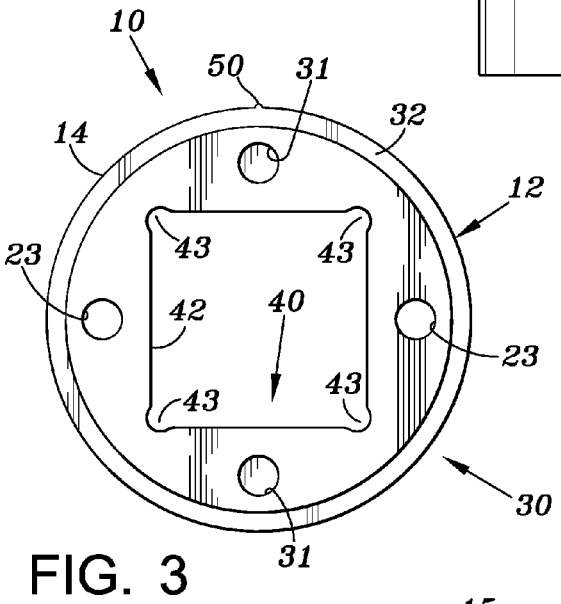
FIG. 3 is an end view of the belt core unit of FIG. 2.

Referring specifically to FIGS. 1 and 3, the second end 30 of belt core 10 comprises the alignment hole 23 extending therethrough, at least one recess 31 and a lip 32. The lip 32 in the embodiment illustrated in FIGS. 1 and 3 is continuous with the outer periphery 14 of the body 12 and, as explained in further detail below, is sized and otherwise configured to engage the shoulder 18 on the first end 15 of an adjacent positioned belt core 10. According to embodiment disclosed herein, the recess 31 extends only partially inside the belt core unit 10; however, the recess 31 may optionally extend through or substantially through the belt core unit 10 to reduce the weight of the belt core 10 and provide additional exposed surface area to effectuate cooling of the belt core unit 10 during manufacture.

In the embodiments illustrated in FIGS. 1-6, the central opening 40 is bound by an interior surface 42 and includes a cross-sectional shape and size to receive a correspondingly shaped and sized winding shaft 36 therein. Preferably, the shape and size of the central opening 40 prevents slipping of the winding shaft 36 relative to the belt core 10 during rotation. Thus, the belt core 10 will rotate via rotation of the winding shaft 36 and undergo the same number of turns as the winding shaft 36 when the winding shaft 36 is rotated. In some embodiments, such as depicted in FIGS. 1 and 3-6, the central opening 40 has a generally square shape to receive a correspondingly shaped winding shaft 36. As depicted in FIGS. 1 and 3-6, the central opening 40 includes a recessed fillet and/or otherwise rounded region 43 disposed at each respective corner of the central opening 40. In operation, the recessed fillets 43 facilitate an easier removal of a belt core 10 from the winding shaft 36. In many embodiments, the recessed fillet 43 is continuous, such that it traverses the entire longitudinal length of the interior surface 42 of the central opening 40. In other embodiments, the fillet 43 includes only a small indent at an end of the interior surface 42. In still other embodiments, the recessed fillet 43 may also include a series of small independent indents spaced apart and formed along the interior surface 42. All or a portion of the interior surface 42 of the centralized opening 40 at ends 15 and 30 may be beveled forming first and second beveled edges 44 and 45, respectively, as best depicted in FIG. 1.

Figure 2:
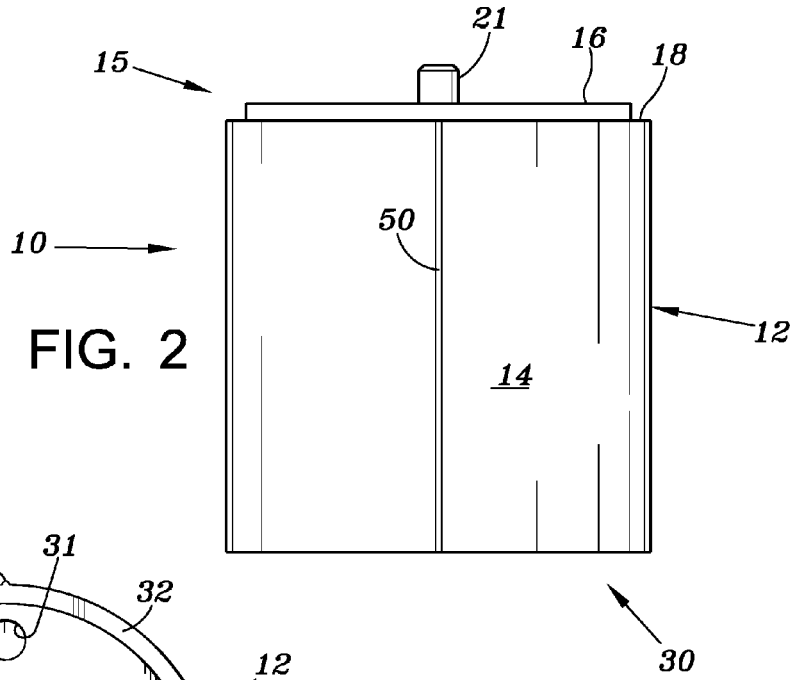
FIG. 2 is a top view a belt core unit of FIG. 1.

In the embodiment illustrated in FIGS. 1 and 2, the position or squaring line 50 is formed on the outer periphery 14 of the belt core 10. The squaring line 50 is generally perpendicular to a cross section of body 12 and extends at least partially between the first and second ends 15 and 30. In FIGS. 1 and 2, the squaring line 50 extends outward from the surface 14; however, in the alternative, the squaring line 50 may be a depression and formed within or otherwise below the outer periphery 14. In other embodiments, the squaring line 50 is painted on the outer periphery 14. In addition, more than one squaring line 50 may be provided on the belt core 10. In operation, the squaring line(s) 50 provide a guide line for aligning an end of a material, such as for example, a belt, that is to be wound and/or otherwise stored on the belt core 10. In some embodiments, at least one squaring line 50 is associated with and generally aligns with the at least one extension 21. In one or more embodiments, a separate squaring line 50 is aligned with each extension 21. Thus, in addition to being used for aligning and securing an end of a belt to a belt core 10, the squaring line 50 can be used to align an extension 21 with a respective recess 31 when securing two or more belt cores 10 together to form the belt core system 8.

The belt core 10 may be formed of any suitable dimension for winding a belt or other object on the belt core 10. In one or more embodiments, a belt core 10 is formed of a length of between about six inches to about twelve inches. In one example, a belt core 10 is manufactured to have a length of 6 inches (measured from first end 15 to second end 30), an overall length of 6¾ inches (measured from the end of extension 21 on the first end 15 to the second end 30), an outer cross sectional diameter of 6 inches, and a central opening 40 diameter of about 3¼ inches (measured diagonally).

A preferred material used to make a belt core unit is a high strength plastic that is structurally rigid and able to withstand a high compressive strain. One exemplary plastic material is a high density polyethylene or nylon so as to avoid and/or otherwise minimize warping or bending when wound with a belt or other winding material, as described in further detail below. When so molded, the formed belt core unit 10 is lightweight and reusable.

According to embodiments disclosed herein, multiple belt core units 10 are manufactured to have at least the same outer cross-sectional diameter and the same central opening diameter, such that, as illustrated in FIG. 6, the belt core units 10 can be stacked and/or otherwise locked together to provide a larger effective length. For example, the ends 15, 30 of each belt core unit 10 are designed such that a first end 15 of a first belt core unit 10 is compatible with and otherwise securable to a second end 30 of a second and adjacently positioned belt core unit 10 to form a belt core system 10 having an expanded or lengthened unit 10 (FIGS. 1 and 6). In particular, the lip 32 of a first unit 10 fits around and is otherwise securable to the shoulder 18 of a second unit 10. During assembly, each extension 21 on the first end 15 of a first unit 10 is aligned with and otherwise inserted within the corresponding recess 31 on a second end 30 of a second unit 10. In the embodiment illustrated in FIG. 1, the extensions 21 and recess 31 are configured, for example, such that a first unit 10 is securable to a second unit 10 at 180 degree positions. In particular, a first unit 10 can be rotated 180 degrees in either direction (about a central axis extending along the longitudinal length of the belt core unit 10) with respect to a second unit 10 and still enable the extension 21 to align with and be insertible within a corresponding recess 31.

When a plurality of belt core units 10 are fittingly engageable as described above and as illustrated in FIG. 6, the belt core system 8 may be prepared to accommodate any width of a belt or other winding material to be wound thereon or even multiple belts or materials thereon. For example, any suitable number of belt core units 10 may be fitted in the manner described above in order to accommodate a variety of material widths. Because belts or other winding materials are oftentimes fabricated to have a width of 24 inches, 48 inches, 60 inches, or 72 inches, a belt core system 10 relying on a belt core unit length of 6 inches (measured from first end 15 to second end 30), will include the fitting of 4 belt core units 10, 8 belt core units 10, 10 belt core units 10, or 12 belt core units 10, respectively, in order to accommodate the respective widths. A similar construction is used when the belt core unit 10 is another length, such as 10 inches or 12 inches. Due to the choice of material for fabricating the belt core unit 10, the belt core unit 10 may also be easily cut at either or both of its farthest ends, if needed. Furthermore, a belt core system 10 can be sized to accommodate multiple belts for ease of storage or transport. For example, two 24 inch width belts can be stored on eight belt core units 10 and secured together for storage or transport via one or more locking rods 34 and locking means 35, as previously discussed.

In a method of preparing a belt core system 8 having at least two units, the units 10 are fitted together so that there is a continuous alignment hole 23 and a continuous central opening 40 that traverses between the first and second ends 15 and 30. The units of the belt core system 8 are then further secured by inserting the locking rod 34 into the continuous holes 23. According to some embodiments, the locking rod 34 will have a length that is greater than the length of the continuous alignment holes 23 so as to enable a locking mechanism 35, such as one or more bolts, to prevent lateral separation of the belt cores 10. When so engaged and secured, a winding shaft 36 is also otherwise disposed in the central opening 40 of the belt core system 8. The belt core system 8 is then able to accommodate a belt or other winding material, in which the width of the belt or other winding material is aligned with the squaring line 50 and then stapled, nailed or otherwise secured to the outer periphery 14 of the belt core system 8.

Referring specifically to FIG. 5, an alternate configuration for securing an end of a belt or other material (not illustrated) to a belt core 10 is illustrated. In the embodiment illustrated in FIG. 5, the belt core 10 includes a slot 60 to receive an end of a belt or other material therein such that as the belt core 10 is rotated, the belt overlays itself and the slot to provide a self-tightening or self-locking arrangement. In this particular configuration, a belt is secured to the belt core without the use of staples, nails, glue or the like and enables the belt core 10 to be reused.

The foregoing description is of exemplary embodiments and methods for operation. The invention is not limited to the described examples or embodiments. Various alterations and modifications to the disclosed embodiments may be made without departing from the scope of the embodiments and appended claims.

What is claimed is:

1. A belt core system comprising:

a first belt core member; and a second belt core member;

each belt core member having a body with an exterior surface, a first end, and a second end, the first end having one positioned shoulder, and the second end having a one positioned lip;

wherein the one positioned lip on the second end of the second belt core member is aligned with and disposed at least partially around and abutting the one positioned shoulder on the first end of the first belt core member to form an expandable belt core system, to receive a belt for storing on the exterior surface of the first and second belt core members; and wherein one or more of the first belt core member and the second belt core member comprises at least one extension extending from at least one of the first end or the second end.

2. The belt core system of claim 1 wherein the first and second belt core members further include an alignment hole extending therethrough such that when the first and second belt core members are abutted, the alignment holes are aligned and configured to receive a locking rod extending therethrough.

3. The belt core system of claim 1, wherein the first and second belt core members each include a central opening extending between and through the first and second ends, the central opening configured to receive a winding shaft extending therethrough.

4. The belt core system of claim 3 further comprising at least one recessed fillet extending at least partially along a length of the central opening to facilitate removal and insertion of the winding shaft into and from the central opening.

5. The belt core system of claim 1, further comprising a squaring line extending at least partially along the exterior surface of at least one of the first and second belt core members.

6. The belt core system of claim 5, wherein the squaring line is integral to and extending from the exterior surface.

7. The belt core system of claim 1, wherein an edge of a central opening at one or more of the first end or the second end of one or both of the first belt core member and the second belt core member is beveled to receive a winding shaft therein.

8. The belt core system of claim 1, wherein the at least one extension is tapered.

9. The belt core system of claim 1, further comprising at least one recess extending from at least one of the first end or the second end of one or more of the first belt core member and the second belt core member, the at least one recess sized to receive a corresponding extension from an adjacently positioned belt core member.

10. The belt core system of claim 1, wherein the body is formed of a plastic material.

11. A belt core system, comprising a first belt core member and a second belt core member, each belt core member having a similarly configured first end, and a similarly configured second end;

an alignment hole in each of the first and second belt core members, and extending along a length of each of the belt core member between and through the first and second ends of each of the belt core members; and a locking rod;

wherein the first end of the first belt core member is positioned adjacent the second end of the second belt core member, such that the alignment holes are coaxially aligned so as to receive the locking rod therethrough, the locking rod including a locking means on opposed ends thereof of the adjacently positioned first and second belt core members, to prevent lateral relative movement between the locking rod and the first and second belt core members.

12. The belt core system of claim 11, wherein the locking means comprises a bolt threadably secured on respective ends of the locking rod to prevent the relative lateral movement.

13. The belt core system of claim 11, wherein the first and second belt core members each include a central opening extending between the first and second ends to receive a winding shaft therethrough.

14. The belt core system of system of claim 13, wherein the central opening further includes at least one region along a length that is recessed to facilitate removal of the winding shaft therefrom.

15. The belt core system of claim 11, wherein the first and second belt core members each include a shoulder on the first end and a lip on the second end, wherein the shoulder on the first belt core member engages the lip on the second belt core member.

16. The belt core system of claim 11, wherein at least one of the first or second belt core members include a squaring line.

17. A molded belt core comprising:

a cylindrical body having an exterior surface, a first end and a second end; and a squaring line on the exterior surface of the cylindrical body that receives a belt, the squaring line extending at least partially between the first end and the second end to provide an alignment mechanism for aligning and securing an end of the belt to the exterior surface of the cylindrical body of the molded belt core for winding thereon.

18. The molded belt core of claim 17, wherein the first end includes a shoulder, and the second end includes an extension extending therefrom, wherein the extension is configured to engage a shoulder on an adjacently positioned belt core.

19. The molded belt core of claim 17, wherein the molded belt core further comprises a shoulder on the first end, a lip on the second end, and a central opening extending between the first and second ends to receive a winding shaft therethrough, and wherein both the first end and the second end are so configured to form an expandable belt core system by either or both the first end or the second end receiving an adjacently positioned molded belt core member.

20. The molded belt core of claim 19, wherein the molded belt core further comprises at least one recess extending outwardly from at least one of the first end or the second end.

* * * * *